US006659198B2

(12) United States Patent
Camp

(10) Patent No.: US 6,659,198 B2
(45) Date of Patent: Dec. 9, 2003

(54) BACK REAMER ASSEMBLY

(75) Inventor: David Camp, Cypress, TX (US)

(73) Assignee: S & S Trust, Commerce City, CO (US)

( * ) Notice: Subject to any disclaimer, the term of this patent is extended or adjusted under 35 U.S.C. 154(b) by 0 days.

(21) Appl. No.: 10/176,188

(22) Filed: Jun. 20, 2002

(65) Prior Publication Data

US 2002/0195277 A1 Dec. 26, 2002

Related U.S. Application Data

(60) Provisional application No. 60/299,615, filed on Jun. 20, 2001.

(51) Int. Cl.[7] ..... E21B 10/26; E02F 5/10

(52) U.S. Cl. ..... 175/53; 175/62; 405/184

(58) Field of Search ..... 175/53, 62, 393, 175/394, 385, 390; 405/184

(56) References Cited

U.S. PATENT DOCUMENTS

| | | | | | |
|---|---|---|---|---|---|
| 3,642,325 | A | * | 2/1972 | Mulvaney | 299/18 |
| 3,750,767 | A | * | 8/1973 | Pessier | 175/53 |
| 5,456,552 | A | * | 10/1995 | Cherrington | 405/184 |
| 5,816,345 | A | * | 10/1998 | Keller | 175/53 |
| 5,921,331 | A | | 7/1999 | Randall | 175/394 |
| 6,250,403 | B1 | | 6/2001 | Beckwith | 175/53 |

* cited by examiner

*Primary Examiner*—Frank Tsay
(74) *Attorney, Agent, or Firm*—Jenkens & Gilchrist, PC

(57) ABSTRACT

The backreamer assembly for enlarging shallow depth boreholes in an earthen environment includes a substantially conical cutting surface. Contained within the substantially conical cutting surface is a speed reduction, torque increasing gearbox which transmits rotational power from a drive motor to the substantially conical cutting surface.

16 Claims, 2 Drawing Sheets

BACK REAMER ASSEMBLY

This non-provisional patent application claims the benefit of U.S. provisional patent application 60/299615, filed Jun. 20, 2001.

FIELD

The present invention pertains to apparatus and method for enlarging subterranean holes using a substantially conical bit mounted at the end of a string of segmented drill pipe or flexible tubing.

BACKGROUND

In recent years the placement of utility service lines in shallow boreholes drilled substantially parallel to the earth's surface has become more common. Initially, these lines were buried by digging a shallow trench, placing the utility service line in the trench, and then re-filling the trench. Later, it was realized that the horizontal and directional drilling techniques used in deep well drilling could be adapted for the drilling of shallow boreholes for utility lines. Now, it is common to see shallow borehole drilling machines, which include a rack of segmented pipe sections, drilling shallow boreholes for utility lines.

The drilling of shallow boreholes for utility lines is typically a two step process. First, a pilot hole is drilled outwardly from a location proximal to the drilling machine. When the shallow borehole reaches its predetermined destination or distal location, the drilling tool is steered upwardly towards the earth's surface or caused to enter an exit pit. It is at this time that the drilling tool, which was used to drill the initial pilot hole is removed and replaced with a backreaming tool. The backreaming tool is then pulled back through the hole to enlarge the borehole to a desired size.

Typical to the subterranean hole boring industry are enlarged drill bits that are utilized in a back drilling, or "backreaming" operation. These enlarged drill bits are known as backreamers. These backreamers are made in various sizes and shapes but are all based on a configuration wherein the drill face is pointed back toward the drilling machine located at the proximal point of the borehole. This configuration enables the bit face to cut while the drill pipe or tubing is pulled back towards the drilling equipment from the distal end of the borehole.

Prior art backreaming tools have been clumsy to use and inefficient. Accordingly, a need remains in the art for a backreaming tool which is easy to use and is efficient.

SUMMARY

The apparatus and method of the present invention includes a backreaming tool assembly for use in enlarging shallow boreholes drilled in an earthen environment which is easy to use and efficient.

The backreamer assembly 10 of the present invention differs from conventional backreamers by the placement of a drive mechanism or transmission inside the backreamer cutting tool. A downhole motor on the end of the segmented drill pipe flexible tubing applies the required rotational force to rotate the cutting tool. The drive mechanism within the backreamer cutting tool is a transmission or gearbox. This allows the input power to the backreamer cutting tool to be increased, thereby increasing the output torque at the face of the backreamer cutting tool which encounters the earthen matter surrounding the hole as the backreamer cutting tool moves through and enlarges the borehole. These transmission gearboxes are of a standard helical or planetary design that provide a reduction in input speed and an increase in output torque.

BRIEF DESCRIPTION OF THE DRAWING FIGURES

A better understanding of the backreamer assembly of the present invention may be had by reference to the drawing figures, wherein.

DESCRIPTION OF THE EMBODIMENTS

Figure 1:
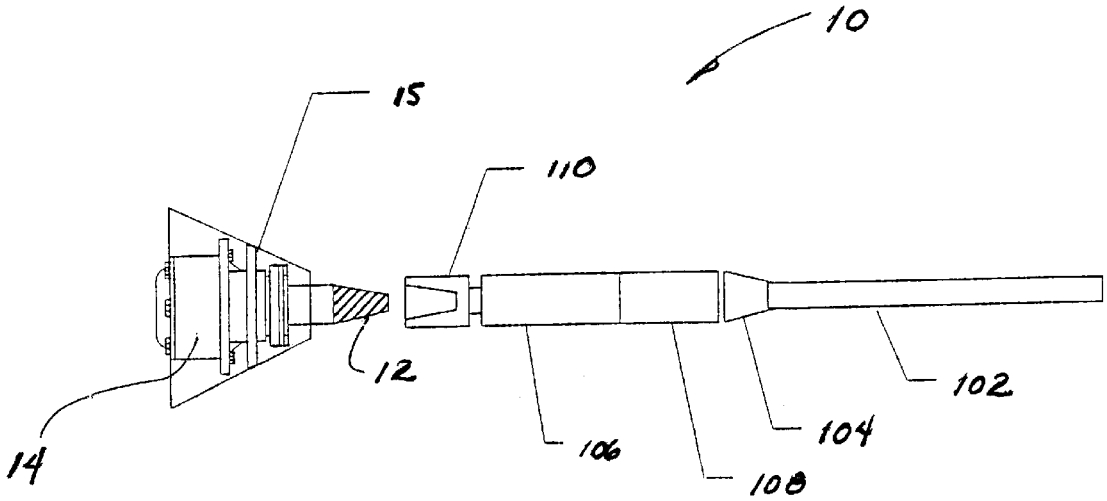
FIG. 1 is a schematic side elevational view of the backreamer assembly of the present invention.

As shown in FIG. 1, a substantially conical backreamer assembly 10 according to the present invention is attached to the end of coiled tubing or a string of segmented drill pipe 102. A connector 104 is used to mechanically adapt the end of the coiled tubing or string of segmented pipe to either a drive motor 106 or to an optimal tracker 108. Such trackers 108 are well known to those of ordinary skill in the art and provide an indication of location by one of a variety of methods including, for example, GPS, sonic, or RF signals. Attached to the drive motor 106 is a connector or bit drive 110 which mates with a threaded extension 12 on the backreamer assembly. The connector or bit drive 110 provides rotational torque from the drive motor 106 to a gearbox 14 substantially contained within the cutting face of the substantially conical backreamer cutting tool 15.

Figure 2A:
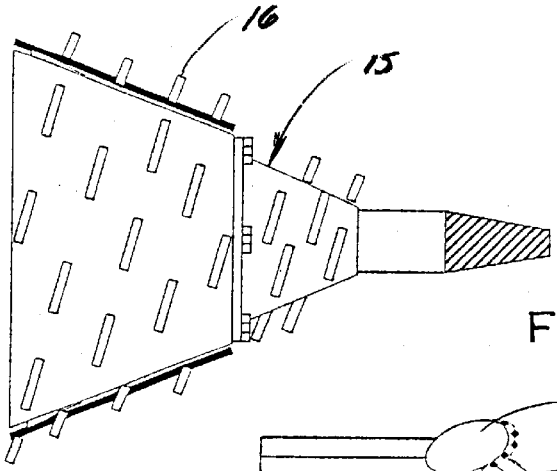
FIG. 2A is a schematic side elevational view of the backreamer assembly with cutting blades.
Figure 2B:
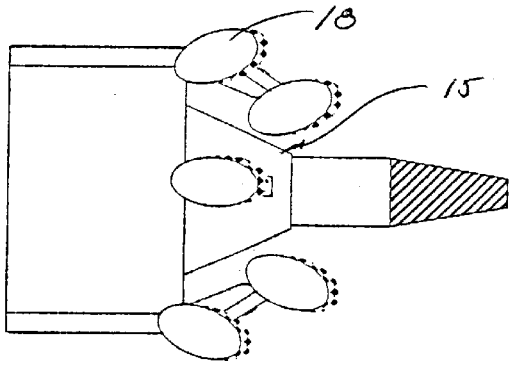
FIG. 2B is a schematic side elevational view of the backreamer assembly with rock bits.

As shown in FIGS. 2A and 2B, the exterior of the substantially conical backreamer cutting tool 15 includes means for cutting into an earthen environment. If the earthen environment is primarily soils, blades 16, as shown in FIG. 2A, are used. If the earthen environment is primarily rock, one or more rock bits 18, as shown in FIG. 2B, are used. To adapt to the need to drill holes for varying diameters, the geometry of the outer surface of the cutting tool 15 may be constructed to be adjustable. Such adjustable diameter earthen drills are well known to those of ordinary skill in the art.

Figure 3:
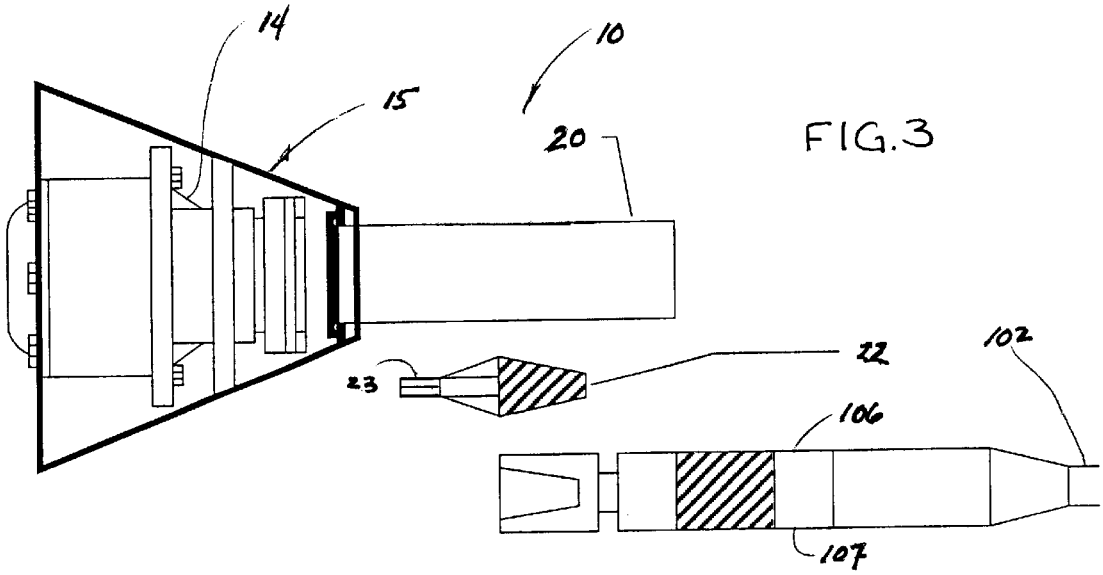
FIG. 3 is an exploded schematic side elevational view of an alternate embodiment of the backreamer assembly.
Figure 4:
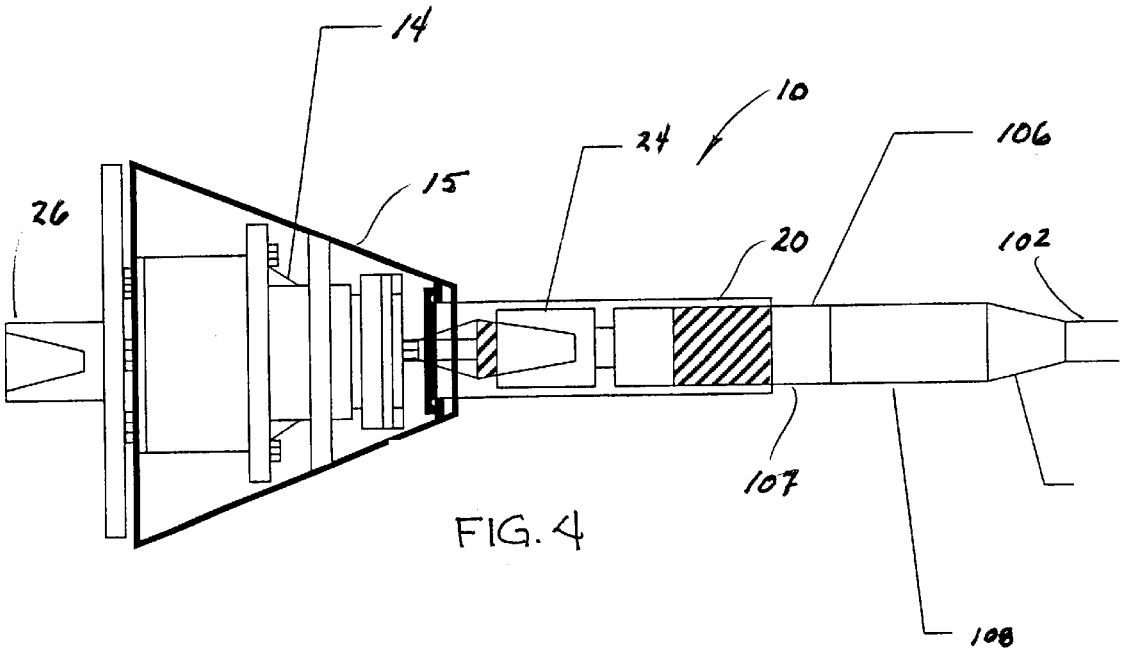
FIG. 4 is a schematic side elevational view of yet another alternate embodiment of the backreamer assembly.

As shown in FIGS. 3 and 4, when the cutting tool 15 is connected directly to a drive motor 106 which may be an electric motor mounted on the downhole end of a string of segmented drill pipe or a coiled tubing string 102, the backreamer assembly 10 of the present invention achieves greater cutting torque than that that can be supplied by the electric motor itself. Specifically, the electric motor may only be capable, after a built in gear reduction, to provide 350 ft. lbs. of torque at 900 rpm. Drilling may not typically occur at an rpm this high, but once the cutting tool 15, including its own gearbox 14, is attached, the applied torque, assuming a 13:1 gear ratio, becomes 4550 ft. lbs. at 70 rpm. This level of torque enables effective backreaming in a variety of different bore hole applications.

The cutting blades 16 on the exterior of the backreamer assembly 10 may be constructed and arranged to surround the gearbox 14. Similarly, the attachment of the backreamer to the drill string or motor may be accomplished in a variety of ways well known to those of ordinary skill in the art. For example, shown in FIG. 3 and FIG. 4 is a hollow sleeve 20 which extends back from the cutting tool 15 and threadably engages the housing 107 surrounding the drive motor 106. Contained within the hollow sleeve 20 is a crossover piece 22 and bit drive 24 which transmits rotational torque from the drive motor 106 to the gearbox 14.

As previously indicated, a still further advancement of the backreamer assembly 10 of the present invention is the ability to provide a variable bit diameter. A variable bit diameter can be achieved by using an adjustable face that either increases or decreases the bit diameter by adjusting the bit face angle. Alternatively, the variability could be achieved using modular additions attached to a coupling 26 on the distal end of the cutting tool 15. Such modular additions include attachment pieces (not shown) that would increase the length of the backreamer, thereby increasing its diameter, or vice versa for decreasing the diameter of the cutting tool 15.

While the present invention shows the drive motor 106 at the end of the segmented drill string or coiled tubing 102, those or ordinary skill in the art will understand that the advancements in motor design may produce an electric motor or a hydraulic motor small enough to be contained within the cutting tool 15.

Alternatively, when a hydraulic motor such as a mud motor which is typically used in downhole drilling operations is used, the mud motor may include an external thread located near the bit drive on the end of the motor housing. This external thread occasionally is utilized to mount various types of collars for stabilization or mud flow around the external surface of the mud motor. In the drilling of shallow boreholes, the mud motor utilizes a blank collar during the initial drilling of the borehole. When it is time to attach the cutting tool 15, the collar is removed and a housing is threaded to the mud motor starting at the bit drive of the motor and moving toward the trailing end. This housing is connected to the body of the cutting tool 15 so that the load is transferred from the face of the cutting tool 15 to the housing through a bearing pack. This housing provides the means to allow a physical connection to the mud motor that can be pulled in tension, so that the gearbox within the cutting tool 15 is not subjected to drilling forces. It is also possible to use a gearbox that would be able to take the direct drilling load, thereby eliminating the need for the housing. Inside of the housing is located the crossover shaft 22 that is threaded into the bit drive 24 of the motor, and the opposing end 23 is inserted into the drive of the gearbox 14, thereby creating a driveshaft transfer. This power transfer insures that all of the energy is directed into the gearbox 14.

Because a mud motor is a hydraulic motor, there is a fluid port through the crossover shaft 22 that allows drilling fluids to pass through to the face of the cutting tool 15. From the shaft, the fluid is ported through the housing to the face of the cutting tool 15 and is prevented via seals from entering into the gearbox chamber. Located on the back side of the cutting tool 15, it would be possible and is intended to provide a coupling 26 that may include a threadable connection to allow for the attachment of other components such as swivels, tracking tools, pipe, etc.

While the system, apparatus, and method have been described according to the preferred and alternate embodiments, those of ordinary skill in the art will understand that numerous other embodiments of the disclosed invention may be made. Such other embodiments shall be included within the scope and meaning of the appended claims.

What is claimed is:

1. A back reamer assembly for enlarging an existing borehole formed in an earthen environment, said back reamer assembly comprising:

a substantially conical means for cutting into the earthen environment;

means for rotating said substantially conical means for cutting into the earthen environment, said means for rotating including:

a speed reduction, torque increasing gearbox constructed and arranged to be substantially contained within said substantially conical means for cutting into the earthen environment;

means for supplying rotational force to said speed reduction, torque increasing gearbox.

2. The back reamer assembly as defined in claim 1 wherein said speed reduction, torque increasing gearbox is connected to said means for supplying rotational force by a bit drive.

3. The back reamer assembly as defined in claim 1 wherein said means for rotating said substantially conical means for cutting into the earthen environment is contained within a housing.

4. The back reamer assembly as defined in claim 3 wherein said substantially conical means for cutting into the earthen environment is threadably connected to said housing.

5. The back reamer assembly as defined in claim 1 wherein said means for supplying rotational force to said speed reduction, torque increasing gearbox is an electric motor.

6. The back reamer assembly as defined in claim 5 wherein said means for supplying rotational force to said speed reduction, torque increasing gearbox is a hydraulic motor.

7. The back reamer assembly as defined in claim 1 further including means for tracking the location of said back reamer assembly while said back reamer assembly is enlarging the existing borehole.

8. The back reamer assembly as defined in claim 1 wherein the geometry of the outer surface of said substantially conical means for cutting into the earthen environment is adjustable.

9. The back reamer assembly as defined in claim 1 wherein said means for cutting into the earthen environment is a plurality of blades.

10. The back reamer assembly as defined in claim 1 wherein said means for cutting into the earthen environment includes at least one rock bit.

11. A method for enlarging a borehole having a proximal end and a distal end, said borehole being previously formed in an earthen environment, said method comprising the steps of:

inserting a string of an elongated cylindrical member through the borehole;

mounting a back reaming tool assembly on said elongated cylindrical member at said distal end of said borehole, said back reaming tool assembly including:

a substantially conical means for cutting into said earthen environment;

means for rotating said substantially conical mean for cutting into the earthen environment, said means for rotating including;

a speed reduction, torque increasing gearbox constructed and arranged to be substantially contained within said substantially conical means for cutting into the earthen environment means for supplying rotational force to said speed reduction, torque increasing gearbox;

rotating the substantially conical means for cutting into the earthen environment of said back reaming tool with said means for supplying rotational force to said speed reduction, torque increasing gearbox;

placing tension force on said elongated cylindrical member to pull said back reaming tool through the previously drilled borehole.

12. The method as defined in claim 11 further including the step of remotely tracking the position of said back reaming tool as said back reaming tool moves through said borehole.

13. The method as defined in claim 11 wherein said speed reduction, torque increasing gearbox is connected to said means for supplying rotational force to said speed reduction, torque increasing gearbox by a bit drive.

14. The method as defined in claim 11 wherein said means for supplying rotational force to said speed reduction, torque increasing gearbox is an electric motor.

15. The method as defined in claim 11 wherein said means for supplying rotational force to said speed reduction, torque increasing gearbox is a hydraulic motor.

16. The method as defined in claim 11 further including the step of adjusting the geometry of the outer surface of said substantially conical means for cutting into the earthen environment.

* * * * *